United States Patent [19]

Prame

[11] 3,999,179

[45] Dec. 21, 1976

[54] DISPLAY PANEL FOR RUNNING CHARACTERS WITH OPTICAL PHASE SHIFT

[75] Inventor: Eric Sune Prame, Lidingo, Sweden

[73] Assignee: International Business Machines Corporation, Armonk, N.Y.

[22] Filed: June 30, 1975

[21] Appl. No.: 591,917

[30] Foreign Application Priority Data

July 1, 1974 Sweden ..... 7408621

[52] U.S. Cl. ..... 340/334; 340/324 M; 340/336; 340/337

[51] Int. Cl.[2] ..... G09F 9/32

[58] Field of Search ..... 340/324 R, 324 M, 334, 340/336, 337, 339

[56] References Cited

UNITED STATES PATENTS 3,493,956 2/1970 Andrews et al. ..... 340/334

3,872,463 3/1975 Lapeyre ..... 340/336

*Primary Examiner*—Marshall M. Curtis

*Attorney, Agent, or Firm*—Joseph J. Connerton

[57] ABSTRACT

A display terminal comprises a running or scanning character display together with a keyboard. The display may comprise a gas panel having a plurality of orthogonal conductors disposed in a gas filled envelope, the intersection of these conductors defining gaseous discharge sites. Phase shifted control signals applied to selected sites of the display are used to improve the optical quality and resolution of the characters displayed without increasing the number of light spots. Alternatively, the number of light spots might be reduced without degradation of optical quality or resolution of the display.

5 Claims, 6 Drawing Figures

⊗ SWITCH ON
x LIGHT
/ SWITCH OFF

DISPLAY PANEL FOR RUNNING CHARACTERS WITH OPTICAL PHASE SHIFT

CROSS REFERENCE TO RELATED APPLICATIONS

U.S. Pat. No. 3,795,908 filed on June 13, 1972 for "Gas Panel with Shifting Arrangement" by Allen W. McDowell and Frank M. Lay.

BACKGROUND OF THE INVENTION

According to the Swedish patent applications 73112401 it is known to control a display panel for running characters by means of a keyboard, which is connected to a computer. It is then possible for the operator to both control the text at the display panel, similar to commonly used inquiry terminals in computer systems, and also to control the optical parameters for the running characters, such as the running speed etc. When the running speed is adjustable it is also possible to use rather few character positions whereby the physical dimensions of the device can be reduced.

A drawback for such known display panels, as also for the display panels with stationary characters, is the difficulty to produce complete lines and curves for the characters or other indications. Through increasing the number of light points, it is of course possible to produce rather complete character forms or other curve forms, but this will always be done through loss of space and control circuits. It would therefore be desirable to be able to use rather few light spots and nevertheless provide complete lines and curves for the characters. This can also be said in another way that it would be desirable to use the optical phenomena for the running characters to form lines and curves in such a way as cannot be made by stationary characters.

It is an object of this invention to provide a display panel for running characters whereby a rather few light spots are used to provide complete line and curve formations preferably for character representations.

It is another object for the present invention to provide an optical display panel whereby the light spots are arranged nonsymmetrically.

It is still another object of the present invention to provide a display panel, whereby phase shifts are used between the switch on and switch off control signals for the light spots.

It is still an object of the present invention to provide an optical display panel with rows and columns, whereby the light spots are arranged in only a few number of cross points for the lines and columns.

The characteristic part of the present invention is disclosed in the attached claims.

BRIEF DESCRIPTION OF THE DRAWINGS

The invention will now be described in connection with the following figures.

DETAILED DESCRIPTION OF THE DRAWINGS

Figure 1:
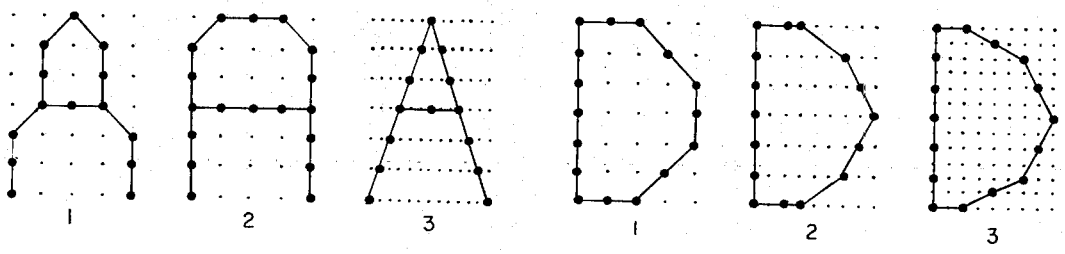
FIG. 1 shows a number of various types of character configurations.

According to FIG. 1 there is shown three forms of the character A and three types of the character D. The drawing A1 illustrates a type of A character in a matrix of 5 × 7 light spots. Another form of the character A is shown in drawing A2 utilizing also a matrix of 5 × 7 light spots. An A of more conventional type is shown in picture A3. This requires, however, a higher resolution matrix of 13 × 7 light spots, especially when the character A will be displayed in a stationary display panel. The picture A3 can, however, be provided in a panel for running characters by means of the present invention in a matrix of 5 × 7 light spots.

The drawing D1 discloses a common form of displaying a character D in a 5 × 7 matrix of light spots. The drawing D2 is provided by increasing the number of vertical light spot columns, while maintaining the number of horizontal rows in the matrix at the same number 7. In drawing D3 has, however, both the number of horizontal and vertical light spot rows been increased as compared to the figure D1.

Both figures D2 and D3 can be provided according to the present invention without increasing the number of light spots over the 5 × 7 matrix, which will be described later. It is evident that the drawings A3, D2 and D3 represent improvements in resolution and definition as compared to the drawings A1, A2 and D1.

Figure 2:
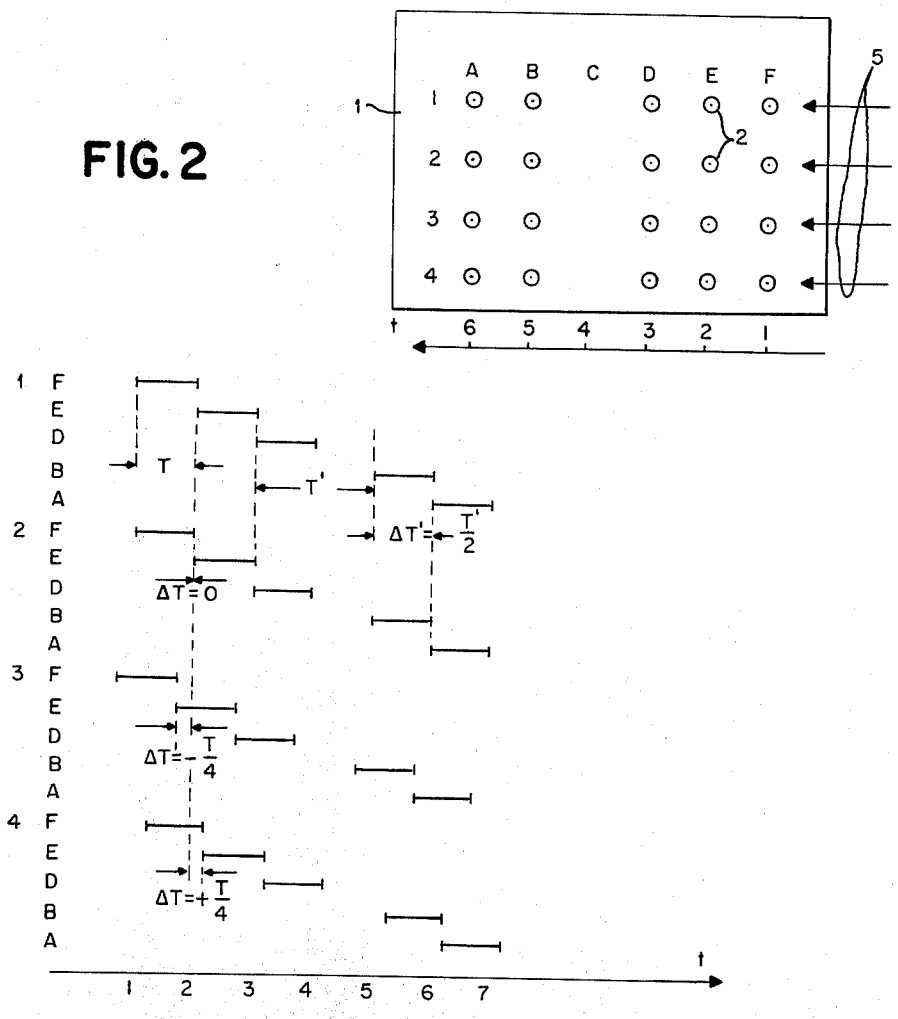
FIG. 2 discloses a display panel according to the present invention and an associated timing diagram.

FIG. 2 illustrates a display panel 1 having a number of rows and columns with light spots 2. The information is schematically shown to be provided on the input lines 5. The light spots 2 are arranged in a matrix with rows 1 – 4 and columns A – F. It is to be noted that in the display panel the column C has no light spots 2. There is an advantage in this arrangement since the excluding of a light spot column may provide some advantages for instance in packaging and lower cost. The disadvantage seems to be that the running text will disappear when passing the column C. According to a per se known optical phenomena it is, however, a reality that the observing operator will see the running text as being completely continuous also in the area of the column C, provided that the running speed for the text is rightly chosen. When an information signal normally is fed on line 1, the first light spot F1 will switch on, then the information will travel to the light spot E1, then to light spot D1, then to light spot B1 and then to the light spot A1. According to the timing diagram it can be seen that the light spot 1F switches on at a time 1 and switches off at a time 2, light spot 1E switches on at a time 2 and off at time 3, light spot 1D goes on at time 3 and off at time 4 and light spot B goes on at time 5 and off at time 6 and further light spot 1A goes on at point 6 and off at time point 7. If we now define as T the time interval from the switch on moment of a first light spot, for instance 1F, to the switch on of the next light spot on the same row, for instance 1E, it can then be seen that this time interval T is valid for all light spots on row 1 except for the light spot D. When light spot D switches on at time 3 it will take a time interval T′ until the next light point B1 switches on on the same row. As compared to the time interval T′ it can be said that light spot A1 switches on a time interval T′ plus a time Δ T′ later, whereby Δ T′ is equal with T′/2. Consequently it can be seen that the switching on of light points on row 1 is synchronous except for the jump from column D to column B.

The switching on of light points on row 2 is completely synchronous with switching on of light spots on row 1. It can, however, be said that the jump from column D to column B will cause a disturbance in the switching on of light points on row 2.

When we analyze the switching on and off of the light spots on row 3 as compared to switching on rows 1 and 2, it can be seen that there is a phase shift. According to the timing diagram this phase shift is shown as $\Delta t = -T/4$. Also for row 4 the switching on signals appear phase shifted compared to the signals fed to rows 1 and 2. The signal arrives somewhat later to row 4, which means that there is a phase shift $\Delta t = +T/4$.

Figure 3:
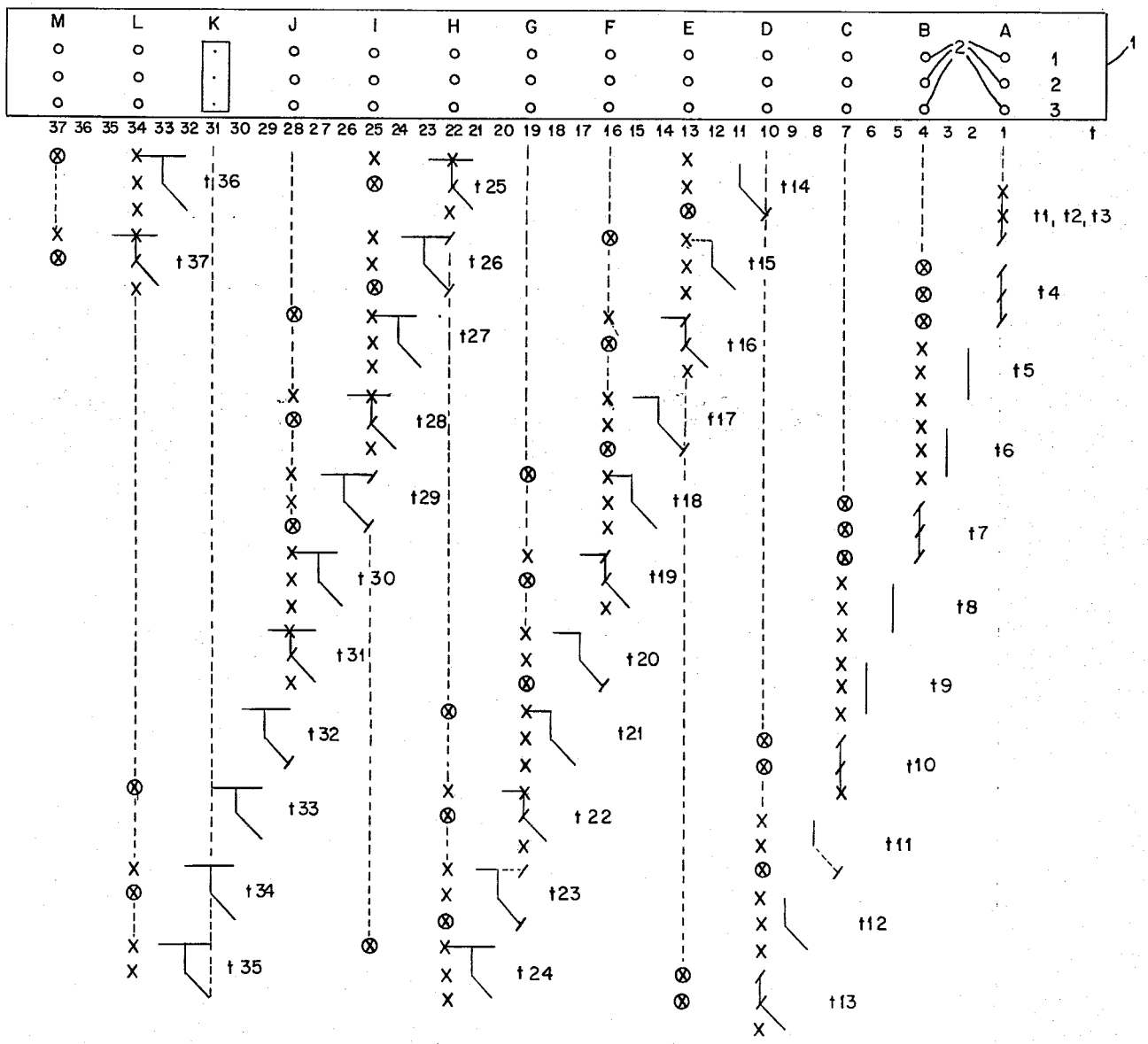
FIG. 3 shows a schematic timing diagram for illustration of the present invention.

In FIG. 3 there is shown a display panel 1 having a matrix of $3 \times 13$ light spots. By means of the attached timing diagram we will now try to principally explain the phenomena of the optical phase shift. The interesting point with a display panel for running characters is that the viewing eye does not recognize the shifting of the light spots as an intermittent phenomena but as a continuous movement. It has been possible to make practical tests by covering a number of light spots with an overlay in a display panel for running characters and nevertheless the viewing eye has seen the text as being complete. It is remarkable that in certain cases up to 80% of the light spots can be laid over and nevertheless the complete text can be seen, however, with rather bad optical quality.

It is not necessary in the present invention to further discuss the physiological phenomena in connection with running characters with optical phase shift. This phenomena will, however, be more practically discussed in connection with FIG. 3.

Referring to FIG. 3 it can be seen that the light spots A1, A2 and A3 are first switched on. This means according to the timing diagram that these light spots are lighted during the time T1, T2, T3. At time T4 the column A will go off and the column B will go on. At this time it can be supposed that the picture is still at column A. At time T5 all the light spots in column B are still lighting, but the picture has moved one step towards B. At the time T6 all the light spots in column B are still lighting but the picture has moved still a step nearer column B. At time T7 the light spots in column B are going off and they go on in column C, whereby the picture has now reached the column B. At time T8 the picture has stepped one step nearer column C and at time T9 the picture has stepped still another step nearer column C.

At time T10 it is supposed that the normal stepping of the optical pattern will be changed in such a way that a delayed phase shift will be introduced into the light spot row 3. This means that at time T10 the light spots C1 and C2 will go off but the light spot C3 will continue to light. Further the light spots D1 and D2 will go on and the picture is now at column C. At time T11 the light spot C3 goes off and the light spot D3 goes on whereby the light spots D1 and D2 are lighted. Further the upper part of the picture has been stepped one step toward column D whereas the lower part of the picture is still at column C. At time T12 the light spots D1, D2, D3 are lighting and the broken picture has been stepped one step nearer column D.

At time T13 D1, D2 go off and E1, E2 go on, whereas D3 is still lighted. The upper part of the picture has reached column D and the lower part is still one step from column D. At time T14 D3 goes off and E3 goes on and the picture starts to move against column E.

At time T15 there is again a change in the system of the switching of the light spots. The light spots in row 1 will switch on one step earlier and at the same time the duration for the lighting time will be increased to four steps instead of the normal three steps. This means that at the time T15 the light spots E1, E2, E3 are lighting and F1 will go on. The picture has stepped one step towards E. At time T16 E1, E2 go off and E3 continues to light. F1 continues to light and F2 goes on. The picture of the pattern is partly advanced from column E partly in column E and partly behind colunmn E.

At time T17 E3 goes off and F3 goes on. F1 and F2 are still lighted and the picture has been stepped one step toward F. At time T18 G1 and F1 go on, F2, F3 are lighted and the picture has been stepped one step toward F.

The time T19 corresponds in principle to time T16, time T20 corresponds in principle to time 17 and time period T21 corresponds in principle to time period T18.

At time T22 there is again a change in pattern. At this time the light spot G1 would normally go off, but now the lighting time for this light spot G1 will be increased with one step so that this spot will continue to light. Instead G2 will go off and G3 continues to light. Further H1 continues to light and H2 goes on. At the next time T23 it can be seen that the pattern has got a new shape, i.e., the pattern is not like the character T. At this time G1 and G3 go off whereabout H1 and H2 continue to light and H3 goes on. At time T24 I1 goes on and H1, H2, H3 continue to light. The pattern T has now been stepped toward H.

At time T25 H2 goes off and I1, H1, H3 continue to light and I2 goes on. At time T26 H1 and H3 go off and I1, I2 continue to light and I3 goes on.

Time T27 will now in principle correspond to time T24. Further time T28 will in principle correspond to time T25 and time T29 will in principle correspond to time T26.

At time T30 there will again start a new sequence of switching. This is due to the fact that column K in the panel will not be displayed. This means that the normal switch on/off sequence over column K will be inhibited. The picture T will, however, be stepped over column K exactly as if it would operate in a normal manner.

At time T30 J1, J2 and J3 are lighted. At time T31 J1 and J3 are lighted but J2 goes off. At time T32 J1 and J3 go off. At time T33 L1 goes on, at time T34 L1 is lighted and L2 goes on. At time T35 L1, L2 are lighted and L3 goes on and at time T36 L1, L2, L3 are lighted and M1 goes on. Finally at time T37 L1 and L3 are lighted, L2 goes off, M1 is lighted and M2 goes on. Then this sequence will continue similar as for the sequence after time T28 or after time T25.

It can be seen that the picture has changed from a first pattern similar to an I, to a second pattern, which looks like a T. This change has been performed by means of phase shifted on/off switching signals, whereby it is of interest to see that the width of the character T is only two thirds of the distance between two light spot columns in the display panel.

Figure 4:
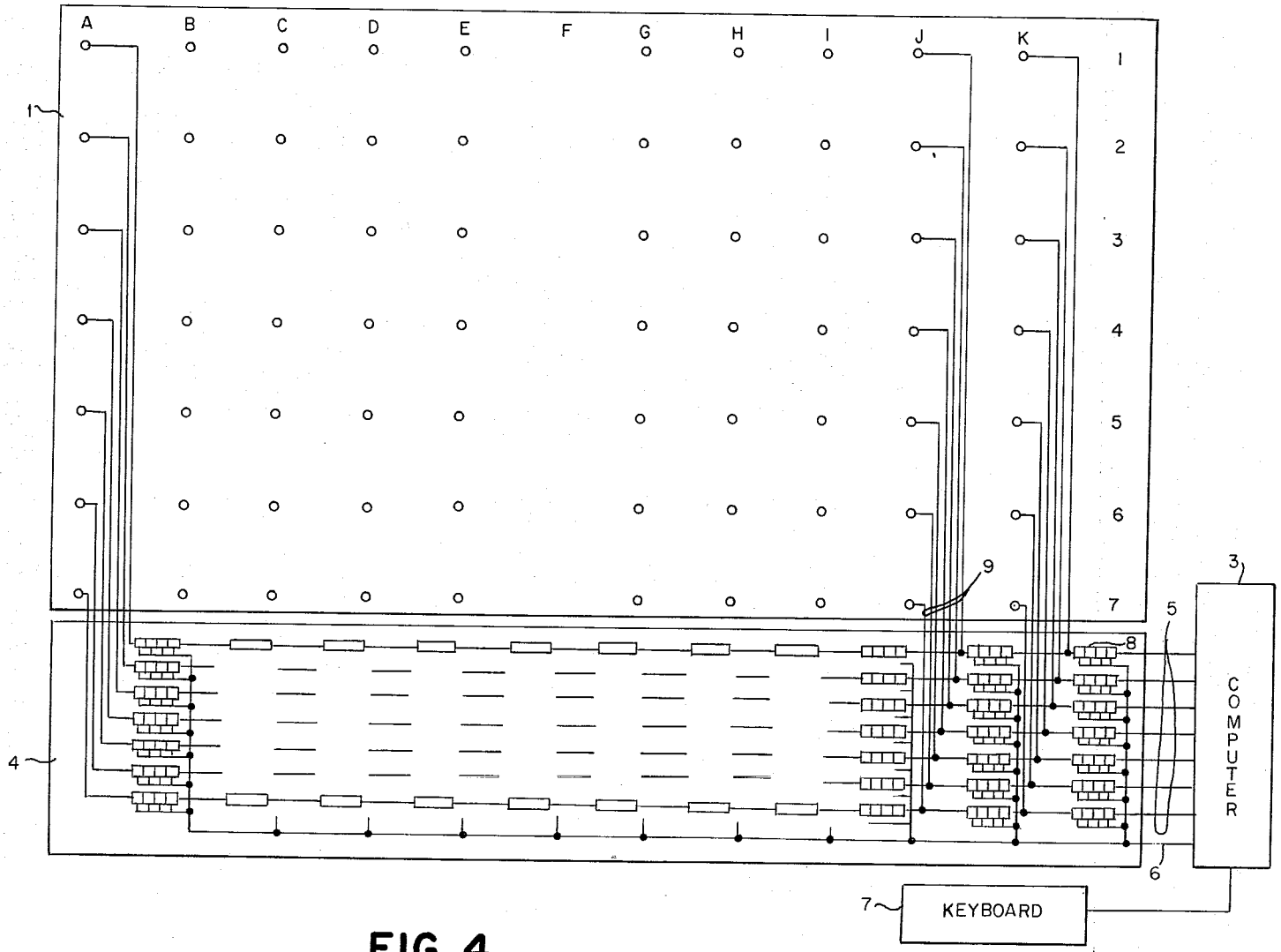
FIG. 4 shows a display panel according to the present invention and attached control circuits.

Referring to FIG. 4 there is shown a display panel 1 according to the present invention, attached control circuits 4, a computer 3 for providing data control signals and a keyboard 7 for controlling the function of the display panel. The computer 3 can for instance be an IBM 370–125 system as described in the IBM Field Engineering Manual SY33–1063, SY33–1059 and in the functional Manual GA33-1506. The keyboard 7 can preferably be such a console keyboard as described in IBM Field Engineering Manual SY33-1065.

The control circuits 4 include a number of serial shift registers 8. Thereby each light spot line in the display panel 1 corresponds to a number of serially connected shift registers, one shift register for each light spot. This means that the output from each shift register is connected partly to the corresponding light spot and partly to the input of the next shift register. A number of data lines 5 are connected from the computer 3 to the input of the shift register rows. A clock signal line 6 is also connected from the computer 3 to the various positions in the shift registers for stepping the shift registers.

The display panel according to FIG. 4 operates as follows. The Operator uses the keyboard 7 as a conventional inquiry terminal whereby the computer 3 starts to send data signals on the data lines 5. These data signals are so decoded, according to the principle of character generation that a suitable running text will be provided on the display panel 1 by means of stepping clock pulses on the clock pulse line 6. This operation is in principle described in detail in connection with FIG. 1 and FIG. 2 in our Swedish patent application 74009788. The difference is mainly in the fact that according to the present invention there are a number of shift register positions corresponding to each light spot, i.e., in the example of FIG. 4 there has been chosen four shift register positions. This means that the data signals on lines 5 can be fed with suitable phase shift to the control circuits 4, in a way as has been described in FIG. 2 and in FIG. 3. This will result in an optical phenomena which for the viewing operator changes the picture pattern on the display panel 1 in such a way as if the panel would include 44 light spot columns instead of 11. The result will be the phenomena as shown in FIG. 1 in the picture 3A and 3D.

It should further be noted that there are no light spots in the column F. Due to the optical inertia in the eye the movement of the optical pattern will, however, not be prevented, as has been explained in connection with column H in FIG. 3. This empty column 1 can then be used for a suitable wire connection, i.e., for packing purposes for the panel control circuits.

It is to be noted that the duration of the data signals on input lines 5 do not need to be equal for all signals. It is possible to create various optical phenomena, as has been shown in FIG. 3, whereby some light spots have a duration of five time periods, other has a duration of four time periods and still other light spots have a duration of three time periods. This means that the display panel according to FIG. 4 can be used partly for phase shift signals and partly for signals with various duration.

Figure 5:
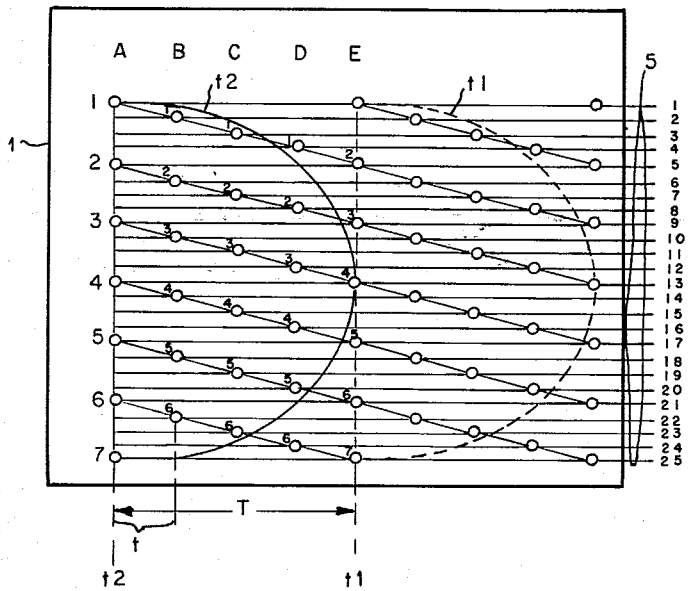
FIG. 5 represents another embodiment of the display panel according to the invention.

Referring to FIG. 5 there is shown another embodiment of the present invention. The display panel has been modified in such a way that the light spot rows are arranged in a small slope downwards. This means that starting from one light spot the adjacent light spot on one side is displaced somewhat downwards in the vertical direction and on the other side displaced somewhat upwards in the vertical direction.

The number of input lines 5 has been increased from seven according to FIG. 5 to twenty-five. In order to make the explanation easier the control circuits 4 including all the shift registers as shown in FIG. 4 are not shown in FIG. 5.

The advantage of the display panel 1 according to FIG. 5 is that by using suitable phase shifted signals on input lines 5 there will be reached almost ideal rounded curves, and this has been done without increasing the number of light spots as compared to the embodiment in FIG. 4. As an example the character D has been chosen corresponding mainly to the character D3 in FIG. 1.

The operation of the display panel 1 according to FIG. 5 will now be explained in connection with the timing diagram in FIG. 6. It is supposed that character signals for the character D has been fed on data lines 1 – 25 and that this character at time T2 according to the principle for running characters has reached the position as shown in FIG. 5 for the solid character D.

Figure 6:
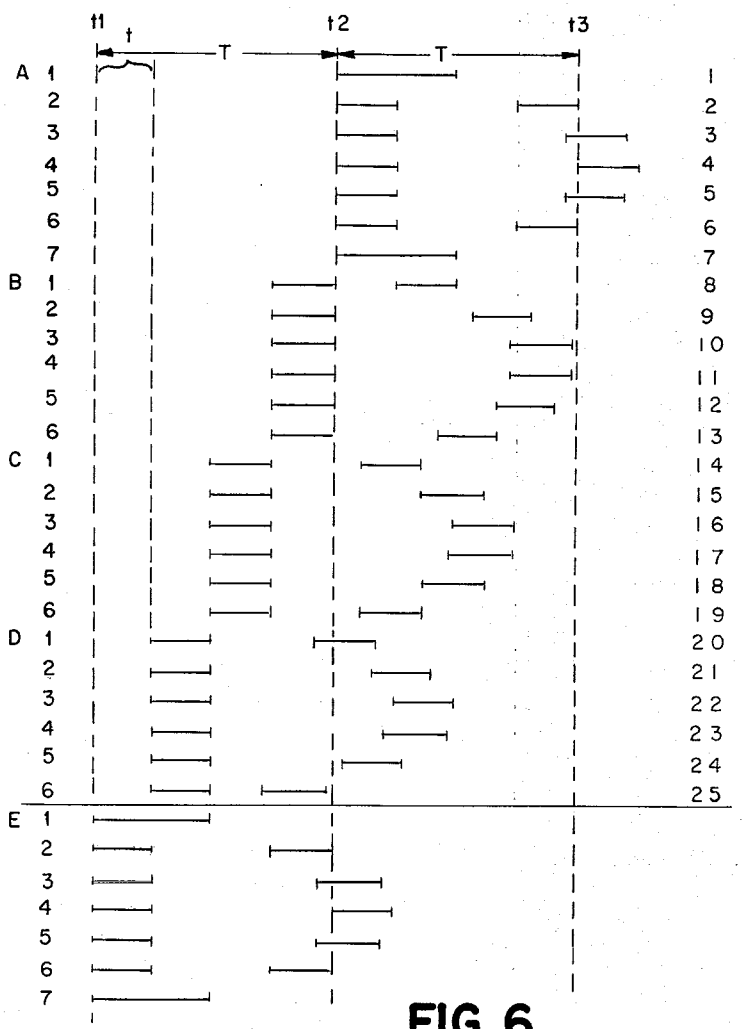
FIG. 6 discloses a timing diagram for the signals in the display panel of FIG. 5.

According to the timing diagram in FIG. 6 it can be seen that at time T2 all light spots in column A are switched on. It can further be seen according to FIG. 5 that except for light spots A1 to A7 there is only the light spot E4 located on the character D. This means according to FIG. 6 that at time T2 E4 goes on. According to FIG. 5 the running direction is from right to left. This means that at time T2 there are several light spots, which very soon will be crossed by the character D, i.e., they will be switched on rather soon after time T2. Such light spots are, for instance, C1, C6 and D5. Sometimes later in the sequence for switching on are the light spots B1, D2 and D4. Further there are such light spots, which at time T2 just have been passed by the contour of the character D. This means that such light spots are switched on just before time T2. According to FIG. 6 it can be seen in the timing diagram that such spots are, for instance, D1, E3 and E5.

If we look at for instance the light spots in column B, i.e., the light spots B1 to B6, it can be seen according to FIG. 5 that the straight part of the character D has passed the light spots B a time interval T before time T2. If now the lighting for each light spot is equal to the time interval T, it can be seen according to FIG. 6 that all light spots B1 – B6 are lighting during the time T before T2. Further all these light spots go off exactly at T2. The light spot B1 will switch on again around the time T2 + T, this means at a time when the rounded part of the character D has reached the light spot B1. The light spot B2 will go on around the time T2 + 2T plus a small time Δ T. The light spot B3 will go on at a time T2 + 3T minus a little time Δ T. Further it can be seen that a light spot B4 will go on approximately at time T2 + 3T. The light spot B5 will switch on a little bit earlier at time T2 + 2T + a small time Δ T. Finally the light spot B6 goes on approximately at time T2 + 3/2T.

In a similar way it is possible to analyze the switching on and off times for the other columns A, C, D and E. These switching on and off times are so chosen that a character D will get a most ideal shape. It can further be seen that switching on and off time for column E is the same as for column A except for a phase shift of $4T = T$. According to FIG. 5 there is shown the character D at time T1 as a dotted contour. At this time the straight part of character D has just reached column E. This can also be seen at the timing diagram in FIG. 6.

According to the discussion above the display panel according to FIG. 5 can be used to display a character D with running characters if the input data signals of the lines 1 – 25 are coded as described in the timing diagram in FIG. 6. In a similar way it is possible to decode 25 signals for any other character. Such coded data signals can be stored in a computer and can be fed out on the input lines 5 to the display panel 1 in FIG. 5. It is evident that the present invention also can be used for displaying of curves and other graphic pictures. The essential point is that the input data are coded in such a way that the running text displays the wanted pattern of the picture. It is also evident that the display panel 1, according to FIG. 5 can be controlled by a number of various methods and by means of various types of addressing. While the invention has been particularly shown and described as referred to a preferred embodiment thereof, it will be understood by those skilled in the art that certain other changes and form of details may be made therein without departing from the spirit and scope of the invention.

What is claimed is:

1. A display device having a number of light spots arranged in lines and columns, and a control circuit for providing switch-on switch-off signals to the light spots, whereby a first switch-on respectively switch-off signal is provided at a time $tn$ to a first light spot and another switch-on switch-off signal is provided to the next light spot on the same row at time $tn + T$, characterized in that a third switch-on switch-off signal is provided to a third light spot at a time $tn + T \pm \Delta T$ whereby the switching-on switching-off of at least one light spot occurs asynchronously compared to the switching-on switching-off of other light spots.

2. A display device according to claim 1, characterized in that said control circuit comprises a number of shift registers, a computer and a keyboard.

3. A display device according to claim 2, characterized in that said shift registers are grouped into a number of serially connected shift registers, one group for each row of light spots, whereby the output for each shift register in a group is both connected to the corresponding light spot and to the input for the next shift register in the group.

4. A display device according to claim 1, characterized in that the distance between two adjacent light spot columns differs from the distance between two other light spot columns.

5. A display device according to claim 1, characterized in that at least one light spot in a column is located on another row as compared to the row at which the nearest light spot for the adjacent column is located.

* * * * *